US010653255B1

(12) United States Patent
Trawinski

(10) Patent No.: US 10,653,255 B1
(45) Date of Patent: May 19, 2020

(54) CONTAINER CAP WITH INTEGRATED STRAW

(71) Applicant: Nicholas M. Trawinski, Winter Garden, FL (US)

(72) Inventor: Nicholas M. Trawinski, Winter Garden, FL (US)

( * ) Notice: Subject to any disclaimer, the term of this patent is extended or adjusted under 35 U.S.C. 154(b) by 800 days.

(21) Appl. No.: 14/963,513

(22) Filed: Dec. 9, 2015

Related U.S. Application Data

(60) Provisional application No. 62/090,637, filed on Dec. 11, 2014.

(51) Int. Cl.

| | |
|---|---|
| ***A47G 19/22*** | (2006.01) |
| ***A47G 21/18*** | (2006.01) |
| ***B65D 41/04*** | (2006.01) |
| ***B65D 47/06*** | (2006.01) |
| ***B65D 25/48*** | (2006.01) |
| ***B65D 41/08*** | (2006.01) |
| ***B65D 50/06*** | (2006.01) |

(52) U.S. Cl.
CPC ..... *A47G 19/2222* (2013.01); *A47G 19/2272* (2013.01); *A47G 21/18* (2013.01); *B65D 25/48* (2013.01); *B65D 41/04* (2013.01); *B65D 41/08* (2013.01); *B65D 47/06* (2013.01); *B65D 50/064* (2013.01)

(58) Field of Classification Search
CPC ..... A47G 19/2222; A47G 19/2272; A47G 21/18; B65D 41/04; B65D 47/06; B65D 2517/0049; B65D 50/064; B65D 77/202; B65D 41/0457; B65D 45/305; B65D 25/48
See application file for complete search history.

(56) References Cited

U.S. PATENT DOCUMENTS

| | | | | |
|---|---|---|---|---|
| 605,321 | A | 6/1898 | Lines | |
| 4,976,364 | A | 12/1990 | Solomon | |
| 5,339,982 | A | 8/1994 | Tardie | |
| 6,050,433 | A | 4/2000 | Russell et al. | |
| 7,156,264 | B2 * | 1/2007 | Ver Hage | A01K 7/06 119/72 |
| 8,777,048 | B2 | 7/2014 | Choi et al. | |
| 8,844,742 | B2 * | 9/2014 | Fujita | A47G 19/2266 215/307 |

(Continued)

OTHER PUBLICATIONS

The Fiji Straw http://store.fijiwater.com/accessories/the-fiji-straw-6-pack.html.

(Continued)

*Primary Examiner* — Mollie Impink
(74) *Attorney, Agent, or Firm* — John Rizvi; John Rizvi, P.A.-The Patent Professor

(57) ABSTRACT

A container cap with integrated straw includes a cap body which carries a drinking straw and is attachable to a beverage container. The container cap engages a neck of the beverage container in a watertight seal to prevent spillage of the beverage from the beverage container during use. A cap retainer can embrace the container cap for enhancing the watertight fitting of the container cap against the neck of the beverage container. The drinking straw can include a distal closed end that opens in the event of user aspiration on the straw. The distal closed end can be provided on the straw or on a disconnectable straw extension.

19 Claims, 14 Drawing Sheets

(56) References Cited

U.S. PATENT DOCUMENTS

| | | | | |
|---|---|---|---|---|
| 9,668,599 | B1 * | 6/2017 | Ellsworth | B65D 51/24 |
| 9,770,667 | B1 * | 9/2017 | Wang-Wu | A63H 3/005 |
| 9,771,195 | B2 * | 9/2017 | Lawson | B65D 51/2807 |
| 2002/0148806 | A1 | 10/2002 | Cheng | |
| 2010/0294772 | A1 * | 11/2010 | Judge | A47G 19/2272 220/288 |
| 2011/0049169 | A1 * | 3/2011 | Rosnak | A47G 19/2266 220/705 |
| 2011/0198361 | A1 | 8/2011 | Chen | |
| 2012/0255973 | A1 * | 10/2012 | Schlueter | B01F 5/0496 222/136 |
| 2015/0102029 | A1 * | 4/2015 | Bargiel | A47G 19/22 220/23.89 |
| 2016/0120343 | A1 * | 5/2016 | Liang | A47G 19/2266 220/303 |
| 2016/0200486 | A1 * | 7/2016 | Meyers | A47G 19/2266 215/229 |
| 2017/0354279 | A1 * | 12/2017 | Lohn | A47G 19/2272 |

OTHER PUBLICATIONS

Adapta-Cap™ Well size M (24 mm) Bottle Adapter with Straw and Valve https://www.aromatools.com/24mm_AdaptaCap_Well_Size_M_p/9284.htm Straw Bottle Cap with Strap http://www.babyonline.com.hk/straw-bottle-cap-with-strap-richell.

* cited by examiner

CONTAINER CAP WITH INTEGRATED STRAW

CROSS-REFERENCE TO RELATED APPLICATION

This application claims the benefit of U.S. Provisional Patent Application Ser. No. 62/090,637, filed Dec. 11, 2014, which is incorporated herein in its entirety.

FIELD OF THE INVENTION

The present invention relates generally to beverage containers, and more particularly, to a container cap with an integrated straw which can be readily attached to a water bottle, soda bottle or other beverage container to enable a child or person of any age to drink a liquid beverage from the container without the risk of spills and without having to first pour the beverage contents from the beverage container into a separate container for consumption.

BACKGROUND OF THE INVENTION

People of all ages have an ongoing need to stay hydrated. Therefore, various types of portable beverage containers which contain water or other liquid beverages for consumption are popular. Some beverage containers may include a neck which is fitted with a removable cap and from which a user dispenses the liquid beverage from the container for consumption. Other types of beverage containers may include a spout, nozzle or like structure from which the liquid beverage may be dispensed from the beverage container. Some beverage containers may utilize a straw which is inserted through an opening in the cap for dispensing of the liquid beverage from the container.

While popular among adults and older children, beverage containers having a removable cap which is threaded or otherwise attached to the container may not be suitable for pre-school or very young children. A young child may have difficulty grasping and removing the cap to access the liquid beverage in the container. Moreover, young children may have a tendency to damage their teeth on the typically hard neck of the container while drinking the container contents.

Young children typically require assistance when drinking from a beverage container to prevent spillage of the liquid beverage contents from the container. Thus, parents or other caregivers may use a "Sippy Cup" into which a liquid beverage is poured for consumption by the child. However, conventional "Sippy Cups" may be inconvenient to use as they may take up a large area of space inside a purse, handbag or suitcase, making it difficult to pack and carry one or more of the "Sippy Cups". In addition, washing "Sippy Cups" on a daily basis may be time-consuming.

Accordingly, there is an established need for an alternative drinking aid that can be easily and efficiently cleaned and stored for carriage, and is safe for use by young children.

SUMMARY OF THE INVENTION

The present invention is directed to a container cap with integrated straw which can be readily attached to a water bottle, soda bottle or other beverage container to enable a child to drink a liquid beverage from the container without the risk of spills and without having to first pour the beverage contents from the beverage container into a separate container for consumption. The container cap with integrated straw includes a cap body which attaches to the beverage container and carries a drinking straw. The container cap engages the beverage container in a watertight seal to prevent spillage of the beverage from the beverage container during use.

In a first implementation of the invention, a container with integrated straw comprises a drinking straw, arranged along a longitudinal direction and comprising a straw intake end and a straw outlet end. A container cap including a cap body extends radially outward from the drinking straw, a neck gripping member extending from the cap body, a cap flange extending from the cap body concentric with the neck gripping member. A neck space is delimited by the neck gripping member and the cap flange. The container with integrated straw further includes a cap receiver, comprising an opening for the passing therethrough of the container cap. The container with integrated straw is configured to adopt a non-sealing position, in which the neck space presents a first size, and a sealing position, in which the cap receiver presses against and deforms the container cap, and the neck space presents a second size smaller than the first size. A user can switch the container with integrated straw from the non-sealing position to the sealing position, and vice versa.

In a second aspect, the neck gripping member and the cap flange extend from the cap body towards the straw intake end.

In another aspect, the drinking straw can be integrally formed with the container cap. Alternatively, the drinking straw and the container cap can be separate parts, and the drinking straw can be insertable through a straw opening in the container cap.

In another aspect, an inner wall of the container cap can be threaded, to thread to a threaded neck of a beverage container. Preferably, the thread is provided on an inner wall of the cap flange.

In another aspect, the cap receiver can be rotatably attachable to the container cap and can include at least one protruding arm. In turn, the cap flange can be terminated in at least one resilient cap lip. In the sealing position, the cap receiver can be rotatably arranged such that the at least one arm pushes the at least one resilient cap lip towards the neck gripping member.

In another aspect, the cap receiver can include a plurality of resilient cap lips arranged in a spaced-apart configuration. In the non-sealing position, each protruding arm can be arranged within a gap defined between each pair of adjacent resilient cap lips.

In another aspect, the thread of the container cap can further extend along an inner wall of the at least one resilient cap lip.

In another aspect, in the non-sealing position, the at least one resilient cap lip may not be deformed.

In yet another aspect, the container cap can further include at least one radially protruding rib, and the cap receiver can include at least one radial notch sized to allow the longitudinal passing therethrough of a radially protruding rib of the at least one radially protruding rib. In the non-sealing position, the at least one radially protruding rib can be arranged in longitudinal registration with the at least one radial notch.

In another aspect, the cap receiver can be rotatable relative to the container cap, and can include at least one longitudinal protrusion extending from the cap body towards the straw outlet end. The at least one longitudinal protrusion can be sized to interfere with an angular displacement of the at least one radially protruding rib of the container cap in rotating the cap receiver relative to the container cap.

In another aspect, the cap receiver can further include a plurality of radial lobes to facilitate gripping and rotating the cap receiver.

In yet another aspect, the container cap can further include a stop extending radially outward from the cap flange, the stop configured to allow the passing thereover of the cap receiver towards the straw intake end and to restrict the passing thereover of the cap receiver towards the straw outlet end. The cap receiver can thus remain secured to the container cap while attached to the beverage container regardless of whether the container with integrated straw is in the non-sealing or sealing position.

In another aspect, the container with integrated straw can further include a straw extension disconnectably attachable to the drinking straw, to increase the total effective length of the drinking straw.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a container cap with integrated straw which can be easily and efficiently stored for carriage and readily attached to a water bottle, soda bottle or other beverage container to enable a child to drink a liquid beverage from the container without having to first pour the beverage contents from the beverage container into a separate container for consumption.

Figure 1:
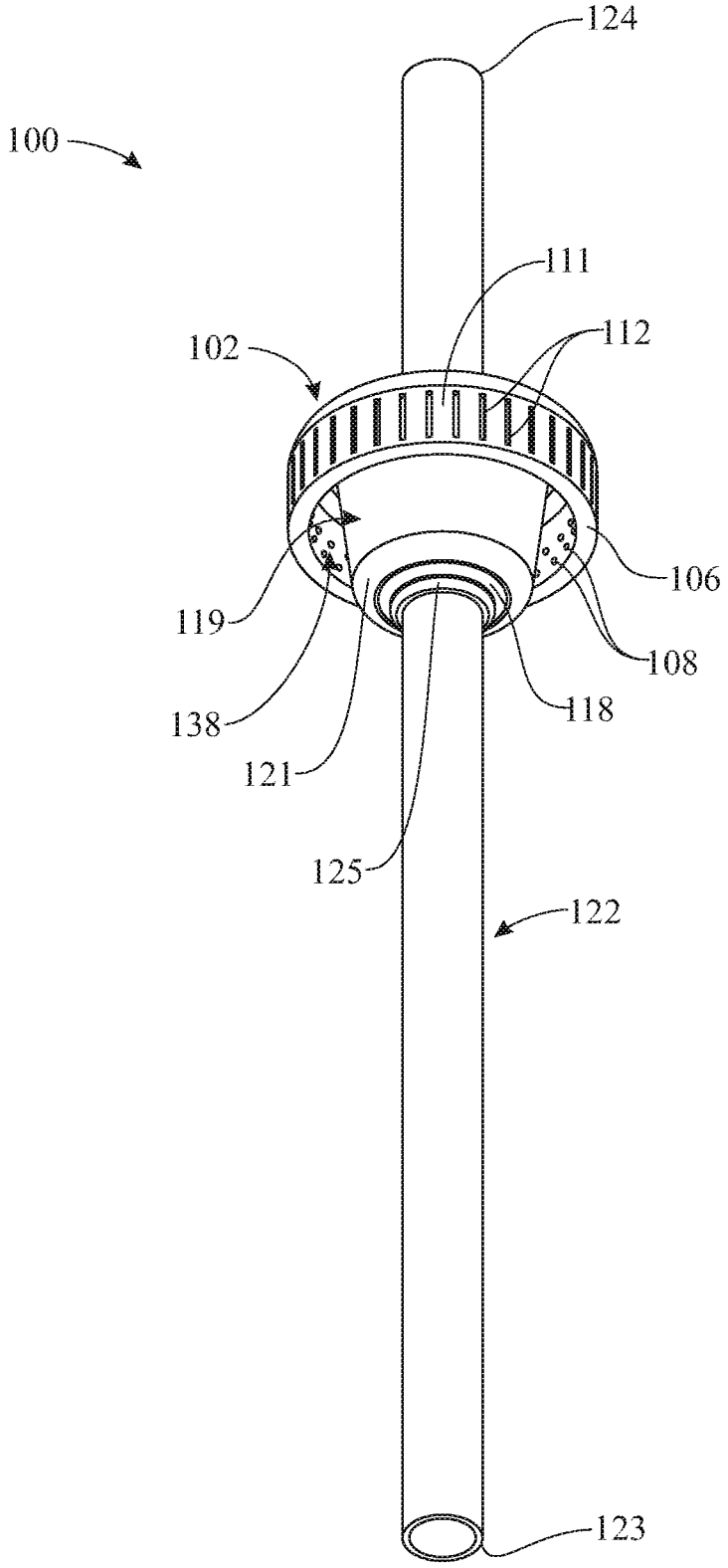
FIG. 1 presents a bottom perspective view of a first embodiment of the container cap with integrated straw of the present invention.
Figure 2:
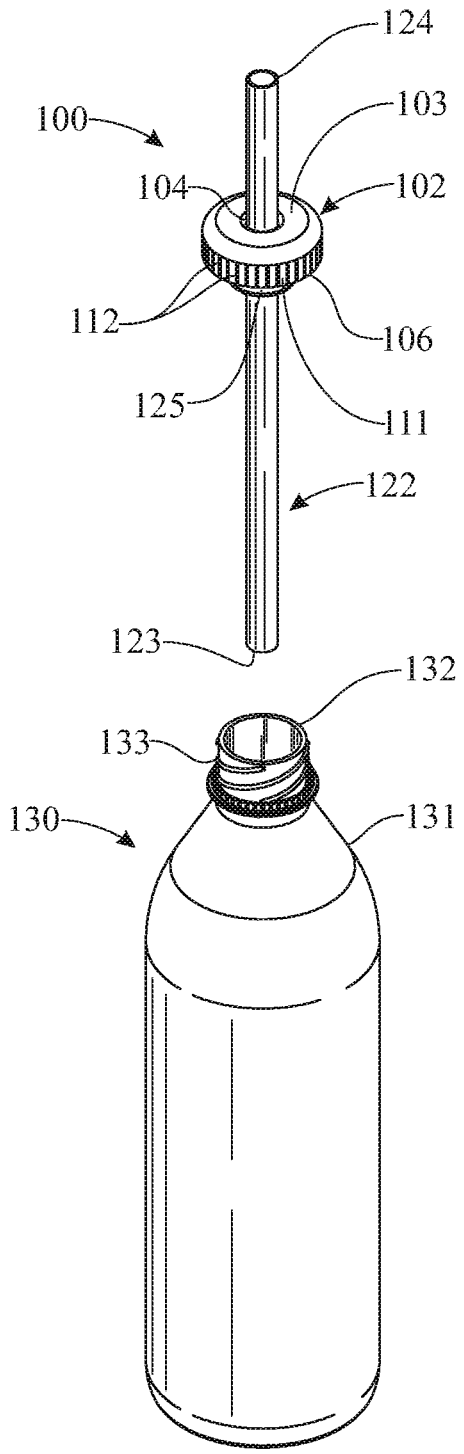
FIG. 2 presents a top perspective view of the first embodiment of the container cap with integrated straw of the present invention, about to be placed on an exemplary beverage container.
Figure 3:
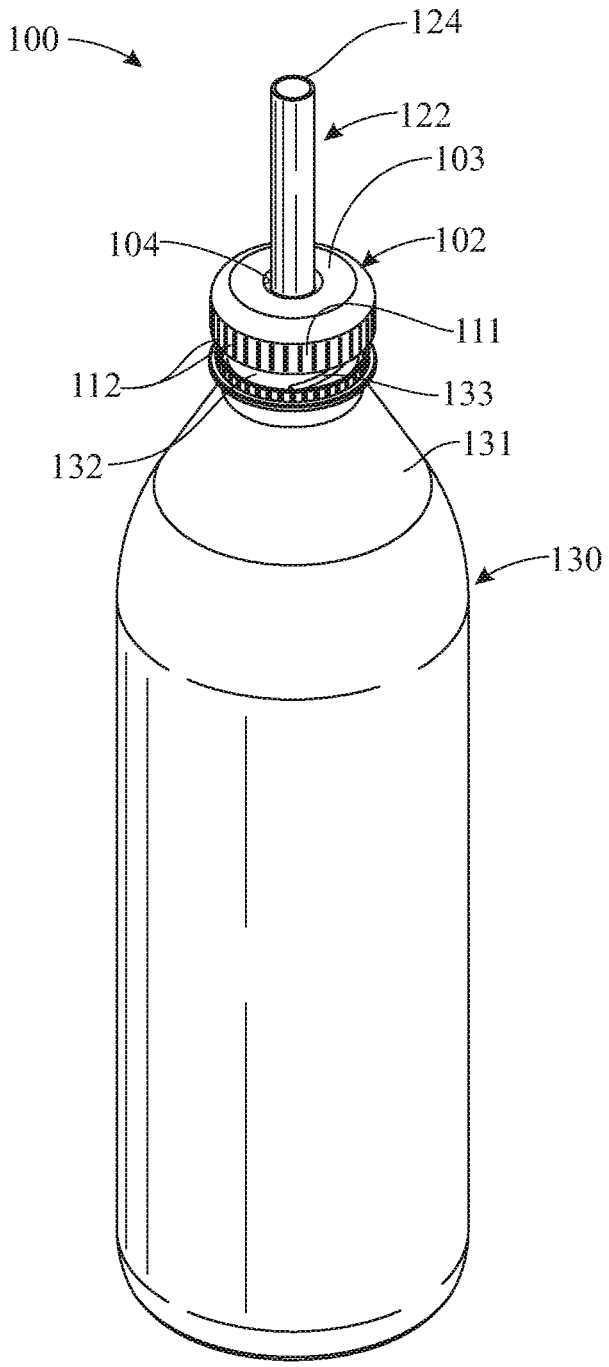
FIG. 3 presents a top perspective view of the first embodiment of the container cap with integrated straw of the present invention and the beverage container of FIG. 2, the container cap with integrated straw shown assembled onto the beverage container.
Figure 4:
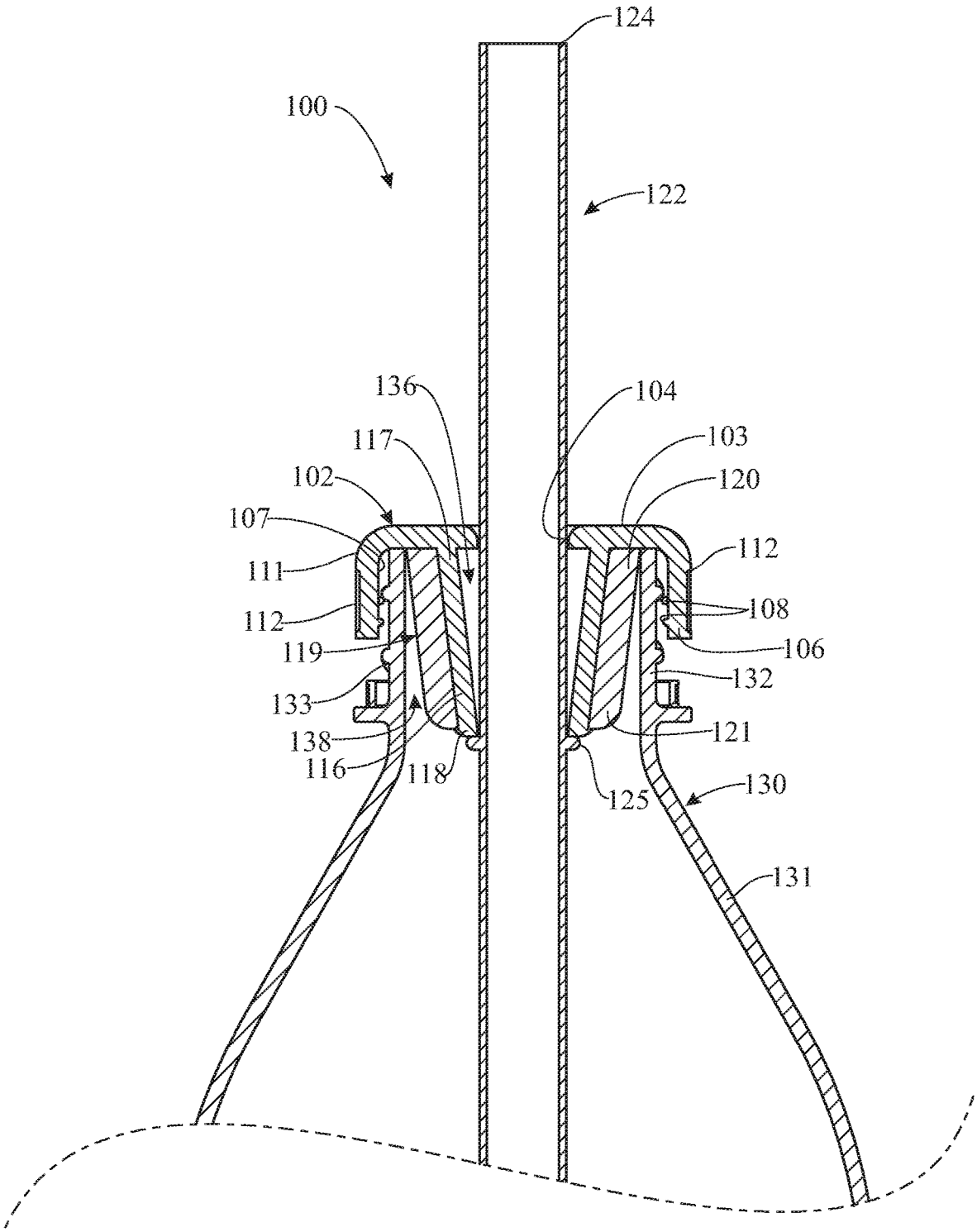
FIG. 4 presents a cross-sectional front elevation view of the first embodiment of the container cap with integrated straw of the present invention and the beverage container in the assembled state of FIG. 3.

Referring initially to FIGS. 1 through 4, a container cap with integrated straw 100 is illustrated in accordance with an exemplary embodiment of the present invention. As illustrated in FIGS. 2 through 4 and will be hereinafter further described, the container cap with integrated straw 100 includes a container cap 102 which may be fitted onto a beverage container 130 such as a water bottle, soda bottle or other beverage container which contains a supply of beverage (not illustrated). A drinking straw 122 extends through the container cap 102 and protrudes vertically downward and upward from the container cap 102 in order to extend into the beverage container 130 and to allow a person to drink from the drinking straw 122, respectively. A user (not illustrated) such as a small child can drink the beverage from the beverage container 130 through the drinking straw 122 while the risk of spilling the beverage from the beverage container 130 is minimized.

The container cap 102 of the container cap with integrated straw 100 may include a top, transverse cap body 103. As illustrated in FIG. 4, a central straw opening 104 may extend through the cap body 103 to allow for longitudinal passing of the drinking straw 122. A cap flange 106 may extend longitudinal or oblique from the cap body 103 of the container cap 102. For instance, the cap flange 106 of the present embodiment extends longitudinally (i.e. in the direction of the drinking straw 122) and is generally cylindrical in shape. The cap flange 106 may have an interior cap flange surface 107 and an exterior cap flange surface 111. In some embodiments, one or more container grip protuberances 108 may protrude from the interior cap flange surface 107 in a selected number and pattern for the purpose of attaching the container cap 102 to the beverage container 130 as will be hereinafter described. Preferably, the container grip protuberances 108 are formed as annular protuberances along the entire perimeter of the interior cap flange surface 107. Multiple grip slots 112 may be provided in the exterior cap flange surface 111 to enhance manual gripping capability of a user in typical application of the container cap with integrated straw 100, which will be hereinafter described.

As further illustrated in FIG. 4, a straw gripping member 116 extends from the cap body 103 of the container cap 102. The straw gripping member 116 may be disposed between and in concentric relationship with the straw opening 104 in the cap body 103 and the cap flange 106 of the container cap 102. The straw gripping member 116 may include a proximal straw gripping member end 117 and a distal straw gripping member end 118. In some embodiments such as the depicted embodiment, the straw gripping member 116 may taper from the proximal straw gripping member end 117 to the distal straw gripping member end 118. In some embodiments, as shown in FIG. 4, the proximal straw gripping member end 117 of the straw gripping member 116 may be fabricated integrally with the cap body 103 of the container cap 102 according to the knowledge of those skilled in the art. In other embodiments, the container cap 102 and the straw gripping member 116 may be fabricated separately. A straw space 136 which communicates with the straw opening 104 in the cap body 103 of the container cap 102 may be formed within the straw gripping member 116.

A neck gripping member 119 may be interposed exterior to the straw gripping member 116. The neck gripping member 119 may include a proximal neck gripping member end 120 and a distal neck gripping member end 121, which can correspond in position to the proximal straw gripping member end 117 and the distal straw gripping member end 118, respectively, of the straw gripping member 116. Accordingly, the neck gripping member 119 may taper from the proximal neck gripping member end 120 to the distal neck gripping member end 121. A neck space 138 which may be annular in shape is formed by and between the neck gripping member 119 and the cap flange 106 of the container cap 102.

The drinking straw 122 extends through the straw opening 104 and the straw space 136 of the container cap 102. As illustrated in FIGS. 1 and 2, the drinking straw 122 may be generally elongated with a straw intake end 123 and a straw outlet end 124. As illustrated in FIG. 4, at least one straw retainer flange 125 may extend outwardly from the drinking straw 122 between the straw intake end 123 and the straw outlet end 124. In some embodiments, the straw retainer flange 125 may be annular in shape and extend radially or transversely from the drinking straw 122. The distal straw gripping member end 118 of the straw gripping member 116 may engage the straw retainer flange 125 on the drinking straw 122 to secure the container cap 102 on the drinking straw 122 and impart a watertight seal between the drinking straw 122 and the straw gripping member 116. Additionally, the straw retainer flange 125 can optionally prevent the drinking straw 122 from being pulled from the container cap 102 when the container cap 102 is in place on the beverage container 130.

The cap body 103, straw gripping member 116 and cap flange 106 of the container cap 102 may be fabricated of a hard plastic or other suitable material. The container cap 102 may be fabricated to accommodate beverage containers 130 having a variety of sizes and shapes. In some embodiments, the neck gripping member 119 of the container cap 102 may be fabricated of a resilient, flexible and compressible material such as silicone, for example and without limitation. The drinking straw 122 may be fabricated of a semi-rigid plastic or other suitable material. The material of construction may be selected such that the drinking straw 122 is sufficiently flexible for safety and sufficiently rigid to resist or withstand chewing.

As illustrated in FIGS. 2 through 4, in typical application, the container cap with integrated straw 100 is fitted on a beverage container 130 to enable a user (not illustrated) to drink a beverage from the beverage container 130. The beverage container 130 may have a conventional design with a container wall 131, a container neck 132 extending from the container wall 131 and exterior container threads 133 on the container neck 132. An interiorly-threaded container lid (not illustrated) may normally engage the container threads 133 on the container neck 132 to seal the beverage in the beverage container 130, typically in the conventional manner.

The container cap with integrated straw 100 may be attached to the beverage container 130 by first unthreading and removing the container lid (not illustrated) from the container neck 132. The container cap 102 is then fitted over the exposed container neck 132. At least one of the container grip protuberances 108 on the interior cap flange surface 107 of the cap flange 106 engages the exterior container threads 133 on the container neck 132 to secure the container cap 102 on the beverage container 130, as illustrated in FIG. 4. In some embodiments, interior cap threads (not illustrated) on the interior cap flange surface 107 of the cap flange 106 engage the exterior container threads 133 on the container neck 132 for the purpose. The drinking straw 122 extends through the straw opening 104 and the straw space 136, respectively, of the container cap 102, and the straw intake end 123 terminates inside the beverage container 130. In some applications, the straw intake end 123 may be positioned at or near the bottom (not illustrated) of the beverage container 130.

The user (not illustrated) places the straw outlet end 124 of the drinking straw 122 in his or her mouth (not illustrated) and draws the beverage from the beverage container 130 through the straw intake end 123, the drinking straw 122 and the straw outlet end 124, respectively, into the user's mouth. As illustrated in FIG. 4, it will be appreciated by those skilled in the art that the distal straw gripping member end 118 of the straw gripping member 116 engages the straw retainer flange 125 on the drinking straw 122 to impart a watertight seal between the drinking straw 122 and the container cap 102, and to prevent the drinking straw 122 from being pulled out of the beverage container 130. Additionally, the container grip protuberances 108 on the interior cap flange surface 107 of the cap flange 106 form a watertight seal between the beverage container 130 and the container cap 102. Furthermore, the typically resilient or compressible construction of the neck-gripping member 119 facilitates a tight fit of the container neck 132 between the cap flange 106 and the neck-gripping member 119; the fact that the neck-gripping member 119 is tapered permits optimum tight sealing to different beverage containers provided with a container neck 132 having a variable diameter and height. Thus, a same container cap with integrated straw 100 can be attached to a variety of containers, and yet efficiently prevents inadvertent spillage of the beverage from the beverage container 130 in the event that the beverage container 130 inadvertently turns over while the typically child user of the container with integrated straw 100 drinks the beverage from the beverage container 130 through the drinking straw 122. The container cap with integrated straw 100 can be readily detached from the beverage container 130 by detaching or unthreading the cap flange 106 from the container neck 132. The grip slots 112 on the exterior cap flange surface 111 of the cap flange 106 may aid a user in gripping the cap flange 106 as the container cap 102 is fitted in place on or removed from the beverage container 130.

It will be appreciated by those skilled in the art that the container with integrated straw 100 may provide an incentive for children to drink more water and less milk and juice, as it can be easily and rapidly be fit onto virtually any commercially-available water bottle. In addition, the container with integrated straw 100 may assist parents or other caregivers by significantly reducing their everyday carry-on bag load in transport. The container with integrated straw 100 may also allow recycled water bottles and the like to be repeatedly used. In some embodiments, indicia or decorative elements which feature images and characters to which children relate may be provided on the container with integrated straw 100. Sports teams may license a team name or logo for placement on the container with integrated straw 100 for sales at sporting events.

Figure 5:
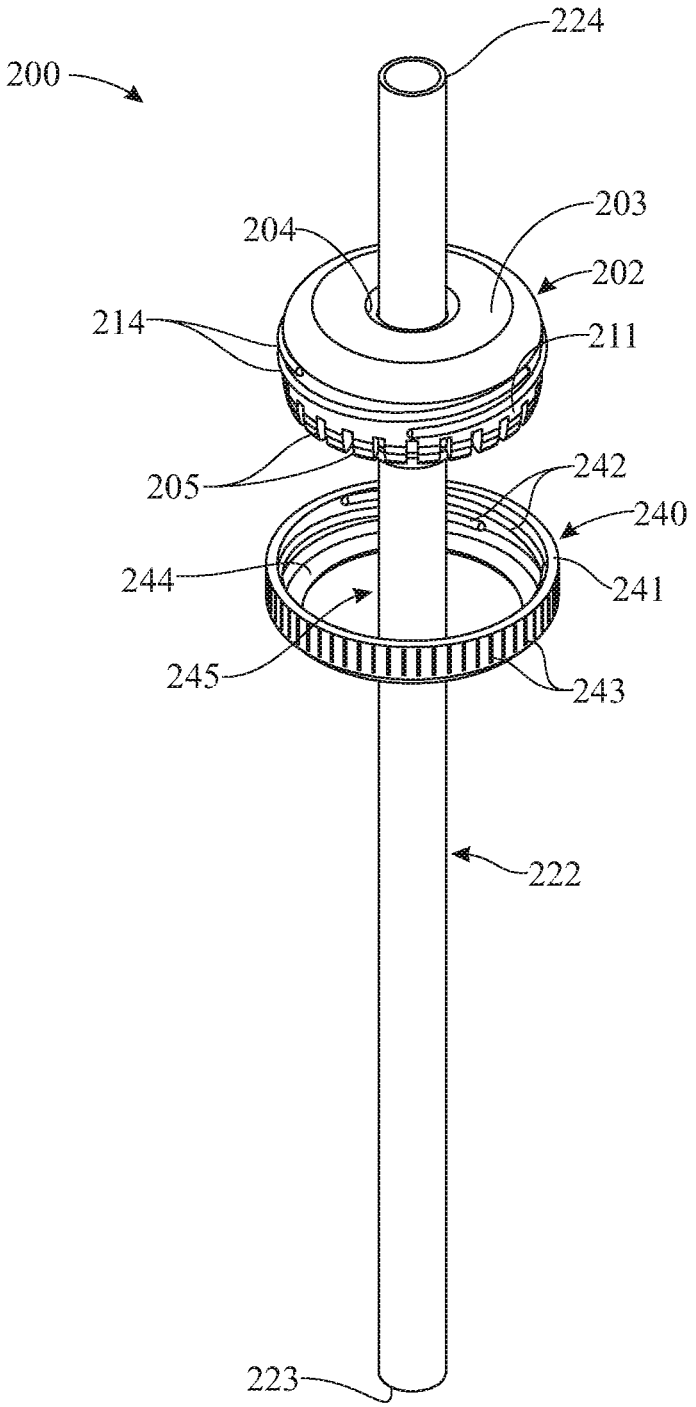
FIG. 5 presents an exploded top perspective view showing a second embodiment of the container cap with integrated straw of the present invention.
Figure 6:
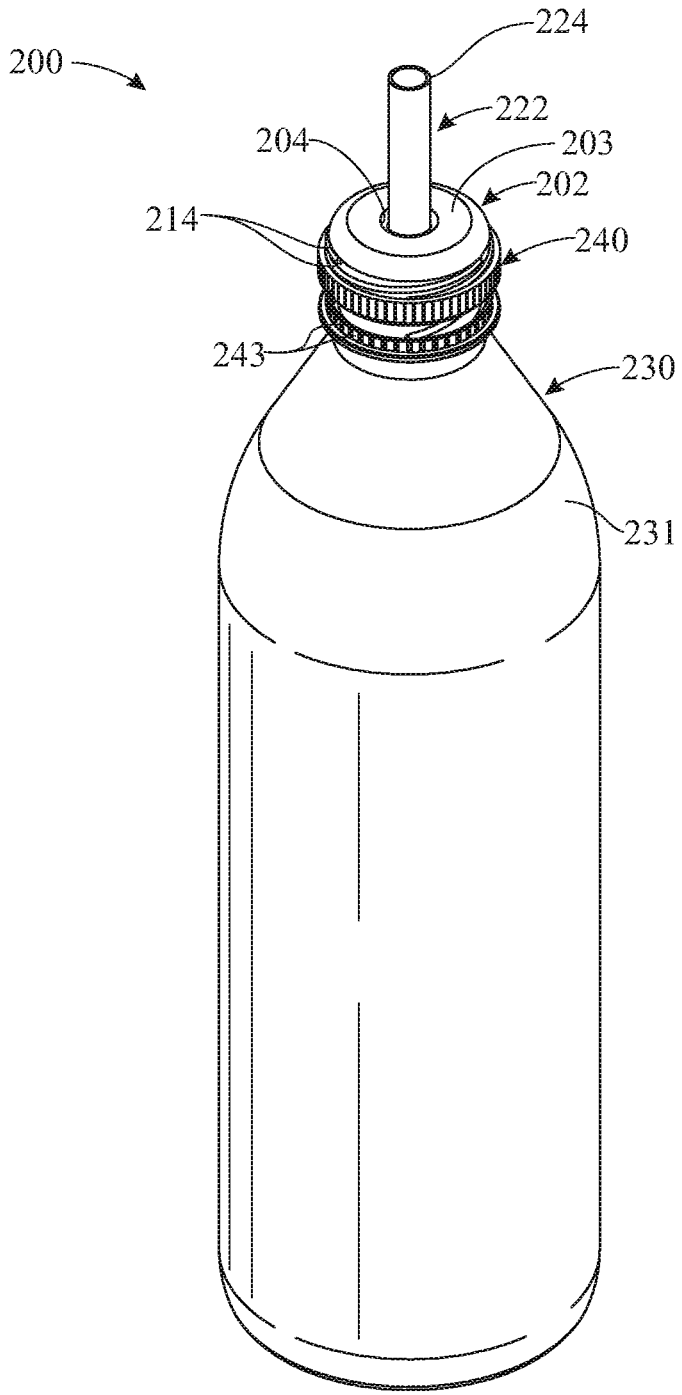
FIG. 6 presents a top perspective view of the second embodiment of the container cap with integrated straw of the present invention, mounted on a beverage container in typical application.
Figure 7:
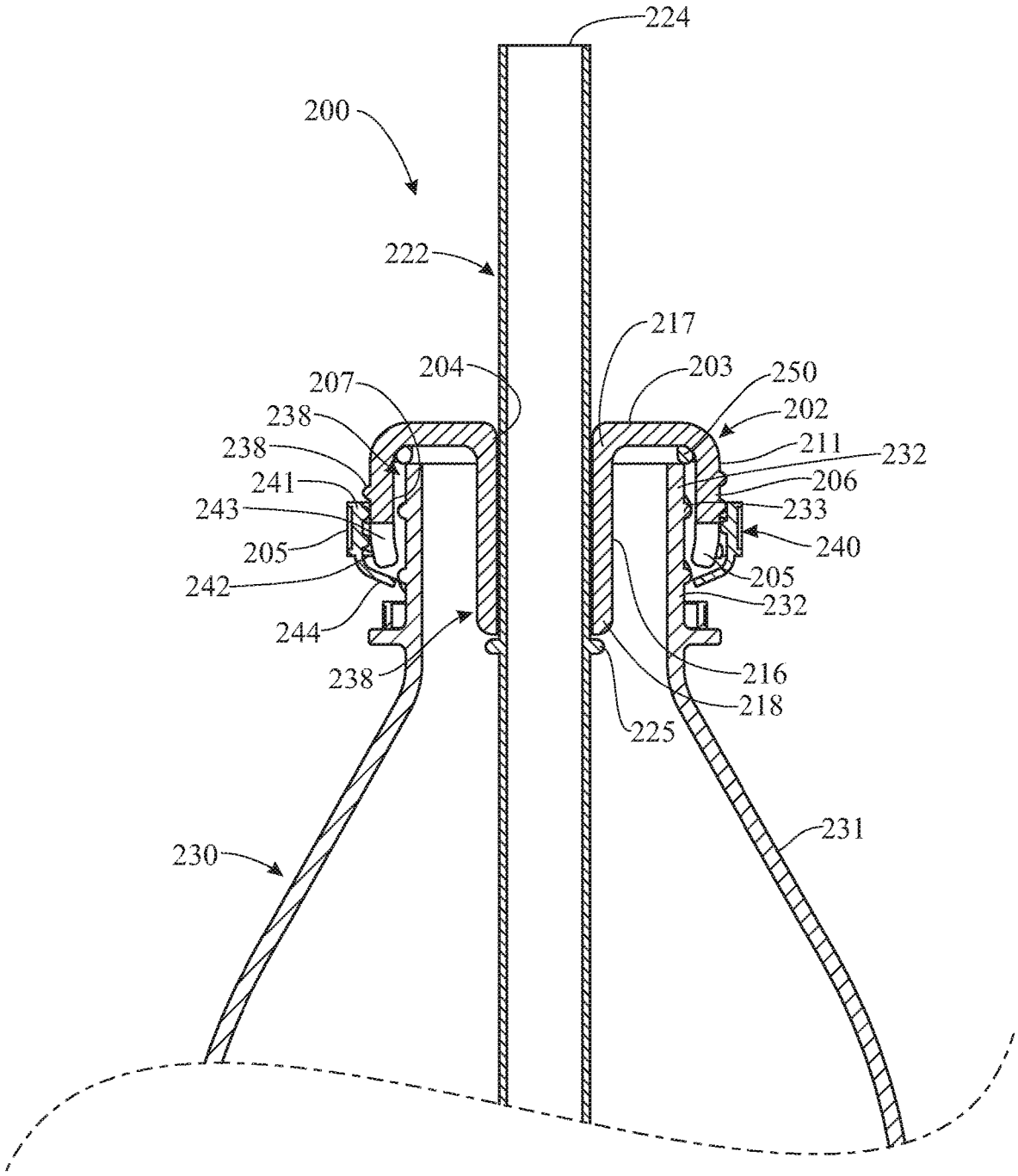
FIG. 7 presents a cross-sectional front elevation view of the second embodiment of the container cap with integrated straw of the present invention, mounted on the beverage container of FIG. 6.

Referring next to FIGS. 5 through 7, a second embodiment of the container cap with integrated straw of the present invention 200 is illustrated. In the container cap with integrated straw 200, elements which are analogous to the respective elements of the container cap with integrated straw 100 that was heretofore described with respect to FIGS. 1 through 4 are designated by the same numeral in the 200-299 series in FIGS. 5 through 7. As best shown in FIG. 7, the container cap with integrated straw 200 of the present embodiment lacks a neck gripping member such as the neck-gripping member 119 of FIG. 4; the neck space 238 is formed by and between the straw gripping member 216 and the cap flange 206 of the container cap 202. In the present embodiment, the straw-gripping member 216 is longitudinal or non-tapered from the proximal straw gripping member end 217 to the distal straw gripping member end 218. At least one flexible or resilient and deformable cap lip 205 may extend from the cap flange 206 of the container cap 202, as best shown in FIG. 5. Exterior cap threads 214 may be provided on the cap flange 206.

A bottom cap receiver 240 may be placed over the cap lip or lips 205 to compress the cap lip or lips 205 against the container threads 233 on the container neck 232 of the container 230. As illustrated in FIG. 5, the cap receiver 240 may include a cap receiver wall 241 which may be annular and has a cap receiver opening 245. Interior cap receiver threads 242 may be provided on the cap receiver wall 241. A cap receiver lip 244 extends from the cap receiver wall 241 into the cap receiver opening 245. In some embodiments, exterior grip slots 243 may be provided on the cap receiver wall 241.

The container with integrated straw 200 may be assembled on the container neck 232 of the container 230 by extending the drinking straw 222 through the straw opening 204 and the straw gripping member 216 of the container cap 202 until the distal straw gripping member end 218 of the straw gripping member 216 engages the straw retainer flange 225. The cap receiver 240 may be placed over the container neck 232 of the beverage container 230. As the container cap 202 is lowered in place over the container neck 232 and rotated to facilitate threaded engagement between the exterior cap threads 214 and the interior cap receiver threads 242, the cap receiver wall 241 of the cap receiver 240 compresses the cap lip 205 of the container cap 202 against the container threads 233 on the container neck 232. Accordingly, the cap receiver 240 compresses and maintains the cap receiver wall 241 of the cap receiver 240 against the container threads 233 to impart a watertight seal between the container neck 232 and the container cap 202. Thus, the cap receiver 240 increases the fitting resistance of the cap receiver 240 on the beverage container 230 and prevents spillage of the beverage from the beverage container 230 during use. The container with integrated straw 200 can include an O-ring seal 250 arranged on an inner surface of the upper, transverse cap body 203 and adjacent to the interior cap flange surface 207 in order to further watertight seal the container cap 202 against the container neck 232.

After use, the container with integrated straw 200 may be removed from the beverage container 230 by unthreading the container cap 202 from the cap receiver 240 and removing the container cap 202 and the cap receiver 240 from the container neck 232 of the beverage container 230.

Figure 8:
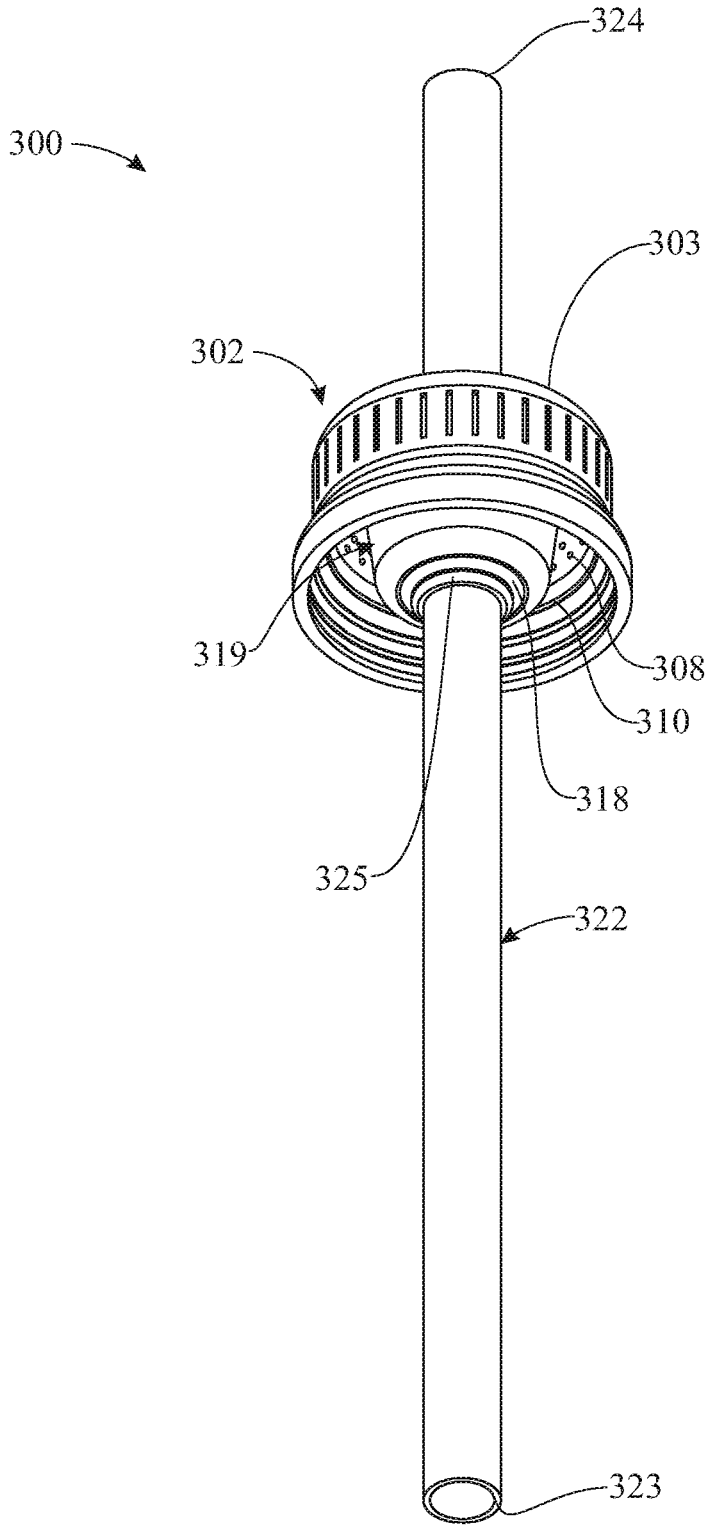
FIG. 8 presents a bottom perspective view of a third embodiment of the container cap with integrated straw of the present invention.
Figure 9:
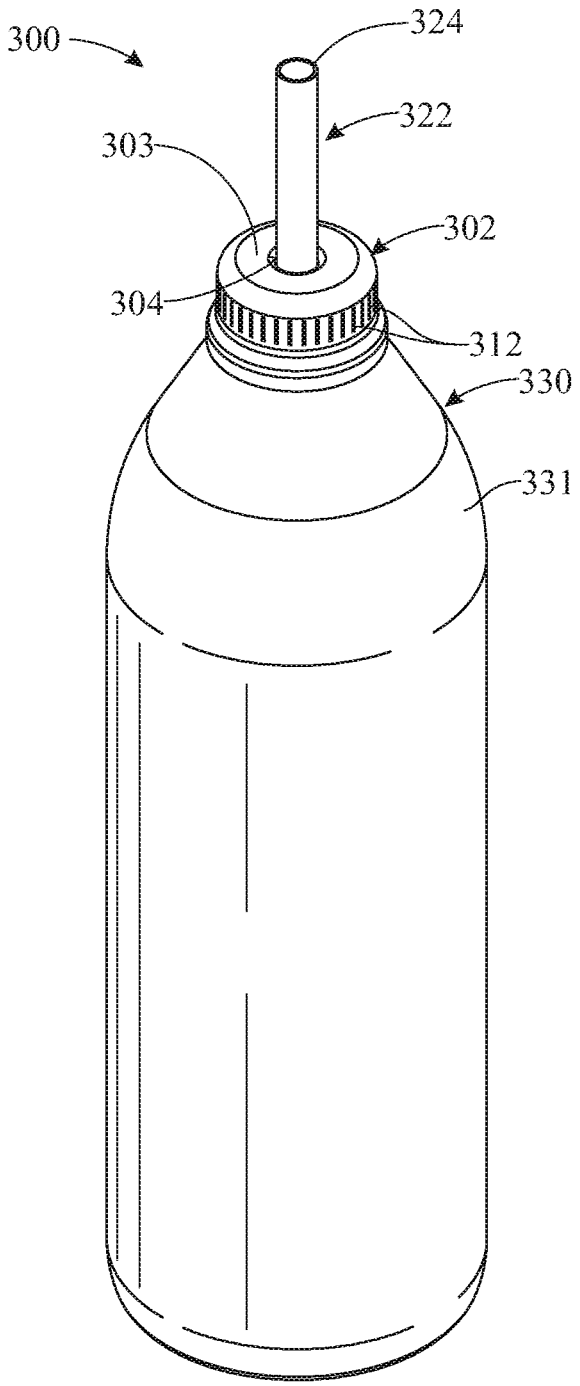
FIG. 9 presents a top perspective view of the third embodiment of the container cap with integrated straw of the present invention, mounted on a beverage container in typical application.
Figure 10:
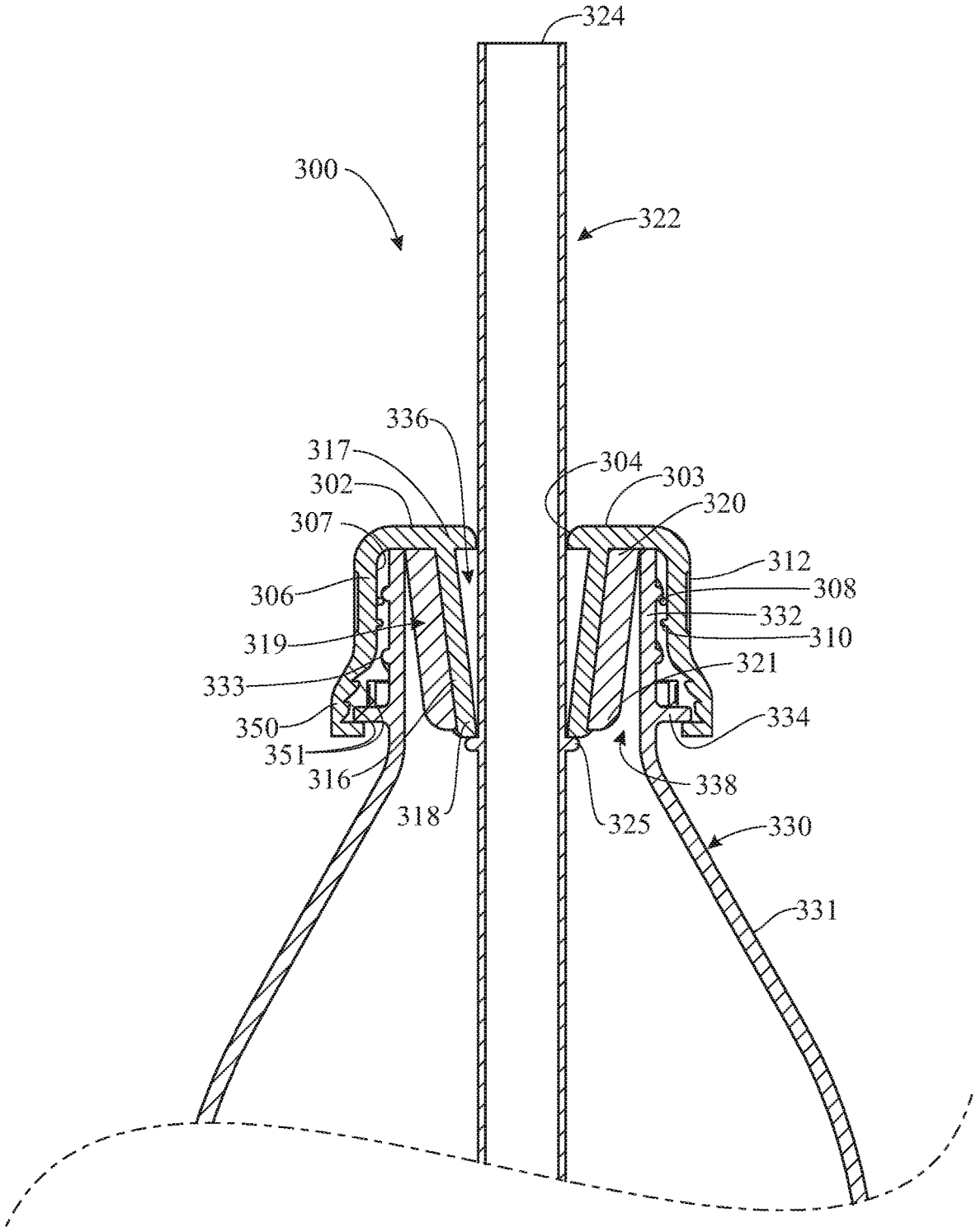
FIG. 10 presents a cross-sectional front elevation view of the third embodiment of the container cap with integrated straw of the present invention, mounted on the beverage container of FIG. 9.

Referring next to FIGS. 8 through 10, a third embodiment of the container cap with integrated straw of the present invention 300 is illustrated. In the container cap with integrated straw 300, elements which are analogous to the respective elements of the container cap with integrated straw 100 that was heretofore described with respect to FIGS. 1 through 4 are designated by the same numeral in the 300-399 series in FIGS. 8 through 10. As best shown in FIG. 10, the container cap 302 of the present embodiment includes a tapered straw gripping member 316 extending inwardly from the cap body 303 of the container cap 302, a neck gripping member 319 interposed exterior to the straw gripping member 316, and an outer generally cylindrical cap flange 306. A cap skirt 350 extends outwardly, in a tapered configuration, from the cap flange 306 of the container cap 302. Multiple cap skirt teeth 351 extend from an interior surface of the cap skirt 350. In placement of the container cap 302 on the beverage container 330, typically as was heretofore described with respect to the container cap with integrated straw 100 of FIGS. 1 through 4, the cap skirt teeth 351 may engage or grip an annular container flange 334 on the container neck 332 of the beverage container 330 to secure the container cap 302 in place on the beverage container 330. Because the cap skirt 350 is tapered, the cap skirt teeth 351 are arranged at different distances from a central longitudinal axis of the container cap 302, allowing the cap skirt teeth 351 to be able to engage annular container flanges 334 having variable diameters and/or longitudinal positions relative to the topmost edge of the container neck 332.

Referring next to FIGS. 11 through 14, a fourth embodiment of the container cap with integrated straw of the present invention 400 is illustrated. In the container cap with integrated straw 400, elements which are analogous to the respective elements of the container cap with integrated straw 100 that was heretofore described with respect to FIGS. 1 through 4 are designated by the same numeral in the 400-499 series in FIGS. 11 through 14. The container cap with integrated straw 400 includes a container cap 402 and a straw 422. Unlike previous embodiments, the straw 422 and the container cap 402 of the present embodiment are integrally formed into a single-piece unit, the straw 422 thus not being removable from the container cap 402.

The container cap 402 includes a transverse cap body 403 extending radially from the straw 422. A downward cap flange 406 extends from the transverse cap body 403. At least one radial rib 413 (four, in the present embodiment) protrudes outwardly from the cap flange 406 for purposes that will be hereinafter explained. In addition, several resilient cap lips 405 extend from the cap flange 406. The resilient cap lips 405 are flexible, can deform or flex inward from an initial relaxed position, and tend to flex outward, back to the relaxed position. The resilient cap lips 405 are spaced apart, thereby forming gaps therebetween, and include an outer recessed area 407 and T-shaped protuberances 410 extend radially from some of the resilient cap lips 405 for purposes that will be hereinafter explained. An internal thread 414 (FIG. 14) is arranged along an inner wall of cap flange 406 and an inner wall of the resilient cap lips 405, for threading onto container threads 433 on a container neck 432 of a beverage container 430. A stop 415 protrudes radially outward from the cap flange 406. The container cap 402 further includes a tapered neck gripping member 419 extending downward from the cap body 403. A neck space 438 is delimited between the neck gripping member 419 and the cap flange 406.

Figure 11:
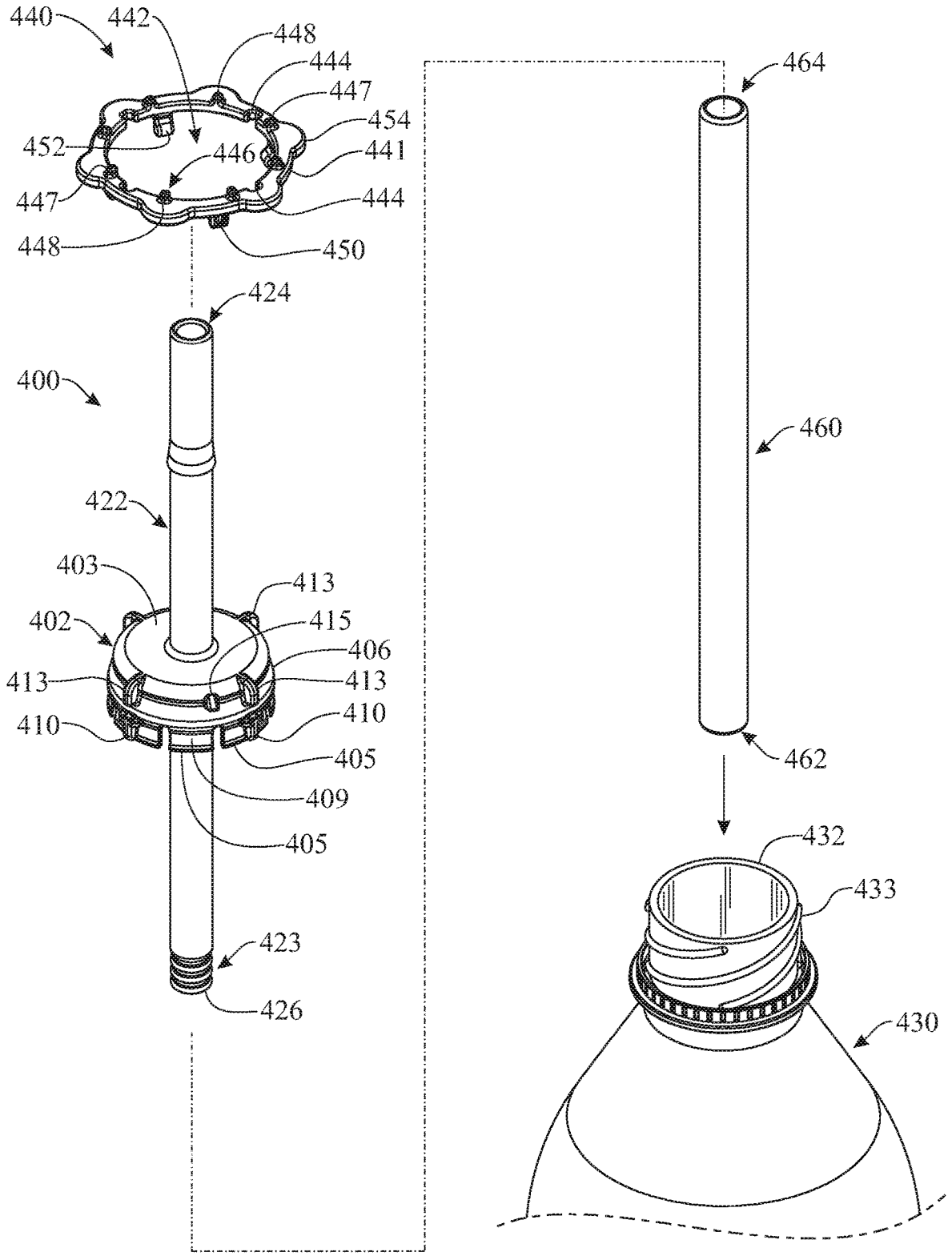
FIG. 11 presents an exploded top perspective view of a fourth embodiment of the container cap with integrated straw of the present invention, shown together with a beverage container.
Figure 13:
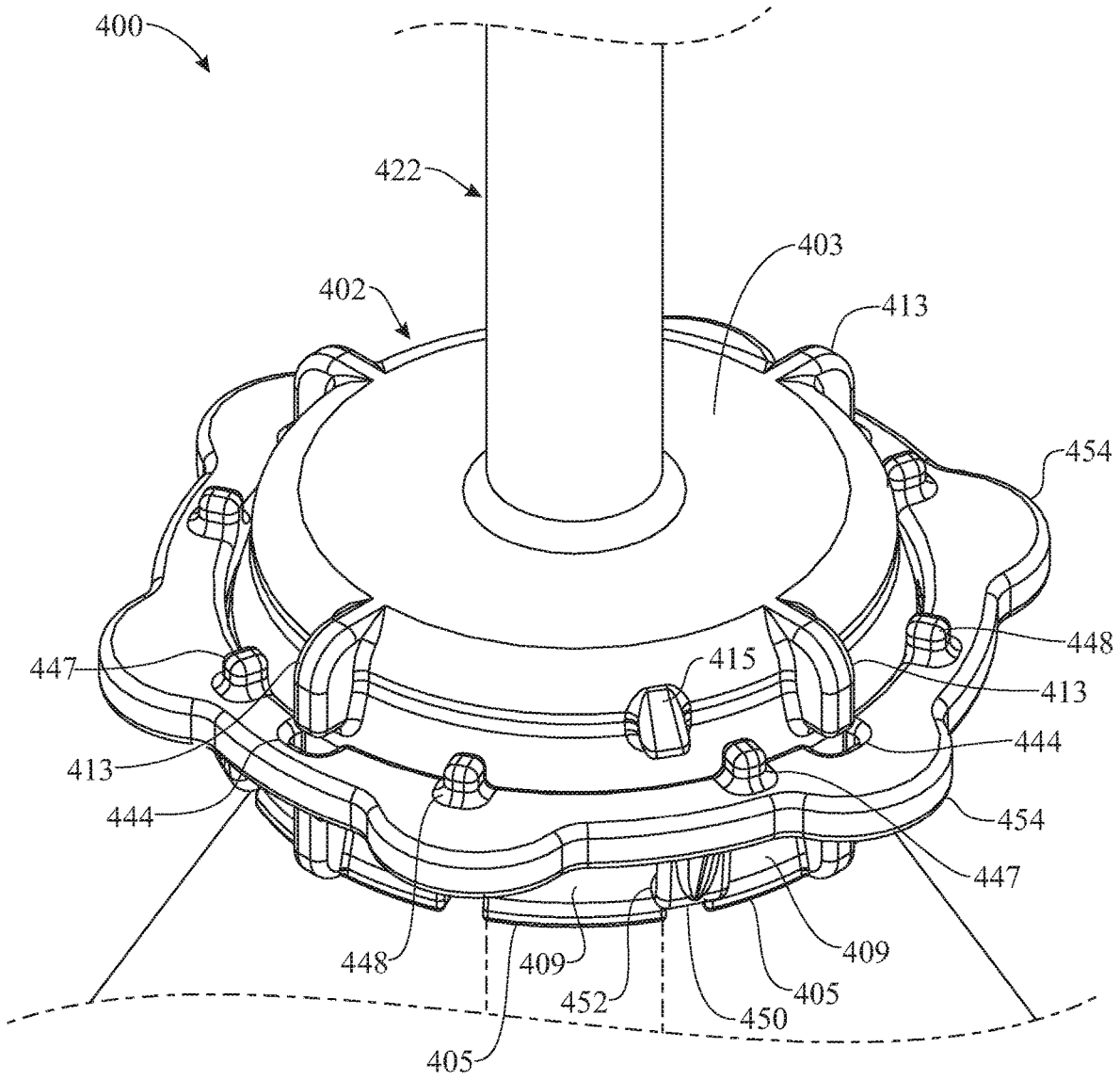
FIG. 13 presents an enlarged, top perspective view of the container cap and securing ring, shown in a first, pre-sealing position.

The container cap with integrated straw 400 of the present embodiment further includes a cap receiver 440, best shown in FIG. 11 and in the enlarged perspective view of FIG. 13. The cap receiver 440 can include a generally ring-shaped cap receiver body 441 defining an opening 442 for the passing therethrough of the container cap 402. Facing the opening 442, at least one radial notch 444 (four, in the present embodiment) is formed to match the at least one radial rib 413 of the container cap 402 in such a way that the one or more ribs 413 can pass through the matching one or more notches 444 when fitting the cap receiver 440 onto the container cap 402. The cap receiver 440 further includes a set of upward protrusions 446 for purposes that will be hereinafter explained. In the present embodiment, the set of upward protrusions 446 includes four pairs formed of a first protrusion 447 and a second protrusion 448. Each pair of a first protrusion 447 and a second protrusion 448 is associated to one notch 444, the notch 444 being arranged between the first protrusion 447 and the second protrusion 448 for purposes that will be hereinafter explained. The cap receiver 440 further includes at least one arm 450 protruding downward from the cap receiver body 441. The arm 450 can end in a radially-inwardly-directed end protrusion 452. In addition, several lobes 454 protrude radially outward from the ring-shaped cap receiver body 441 to facilitate manual gripping and turning of the cap receiver body 441.

Figure 12:
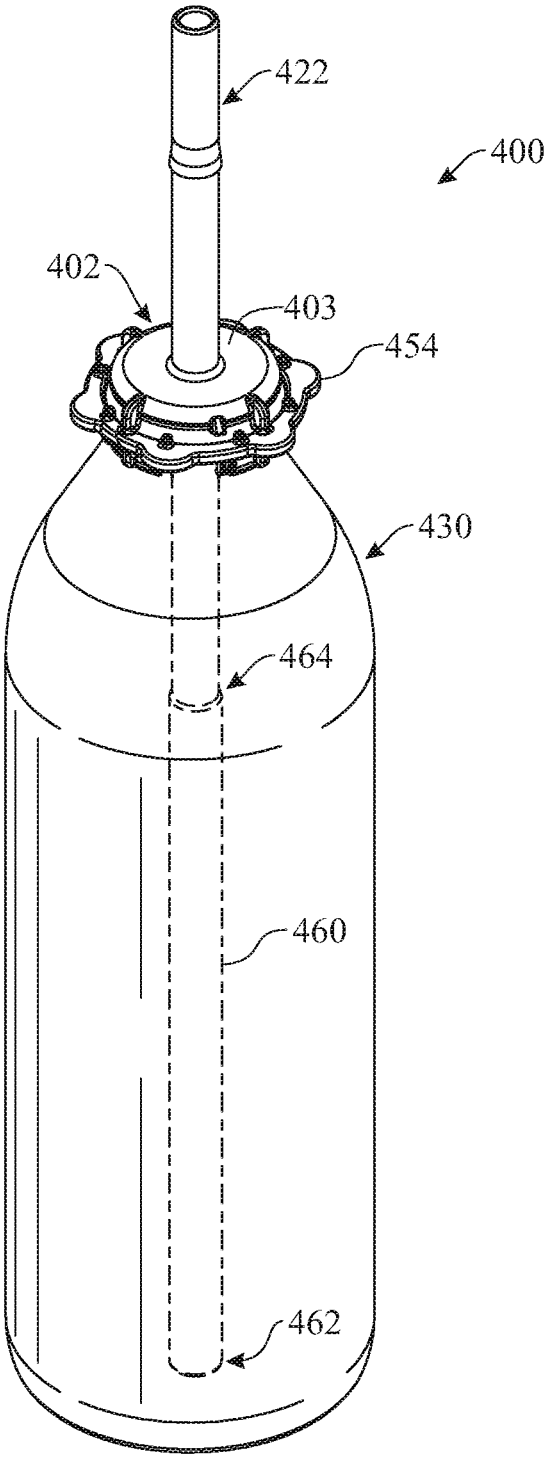
FIG. 12 presents a top perspective view of the fourth embodiment of the container cap with integrated straw and the beverage container of the previous figure, shown assembled.

Similarly to the previous embodiments, the straw 422 depicted herein is provided with a straw intake end 423 and a straw outlet end 424. However, the straw intake end 423 of the present embodiment is different in that it includes a thread 426 for connecting a straw extension 460. The straw extension 460, in turn, is provided with a straw extension intake end 462 and a straw extension outlet end 464, the latter being internally threaded (not shown) to allow the straw extension outlet end 464 to couple to the straw intake end 423 of the straw 422. The illustration of FIG. 12 shows the straw extension 460 attached to the straw 422, allowing to increase the total effective length of the straw and to utilize the container cap with integrated straw 400 with taller beverage containers. In some embodiments, the straw extension 460 can be made from a soft and flexible material such as, but not limited to, silicone, allowing the straw extension 460 to bend in the event that it reaches a bottom surface of the beverage container 430, and thus to adjust to beverage containers of different heights. In certain embodiments, the straw extension intake end 462 can be closed and flexible, and can include at least one slit that opens in the event that a user aspirates (sucks) on the straw 422 and creates a depression within the straw 422 and straw extension 460; such an arrangement renders the assembly of the straw 422 and the straw extension 460 leakproof when the user is not aspirating on the straw 422. The container cap with integrated straw 400 may also be used without the straw extension 460. Alternative embodiments are contemplated which do not include a straw extension 460. In some embodiments, the straw 422 itself can include a closed, flexible distal end having at least one slit that opens in the presence of user aspiration on the straw 422.

Figure 14:
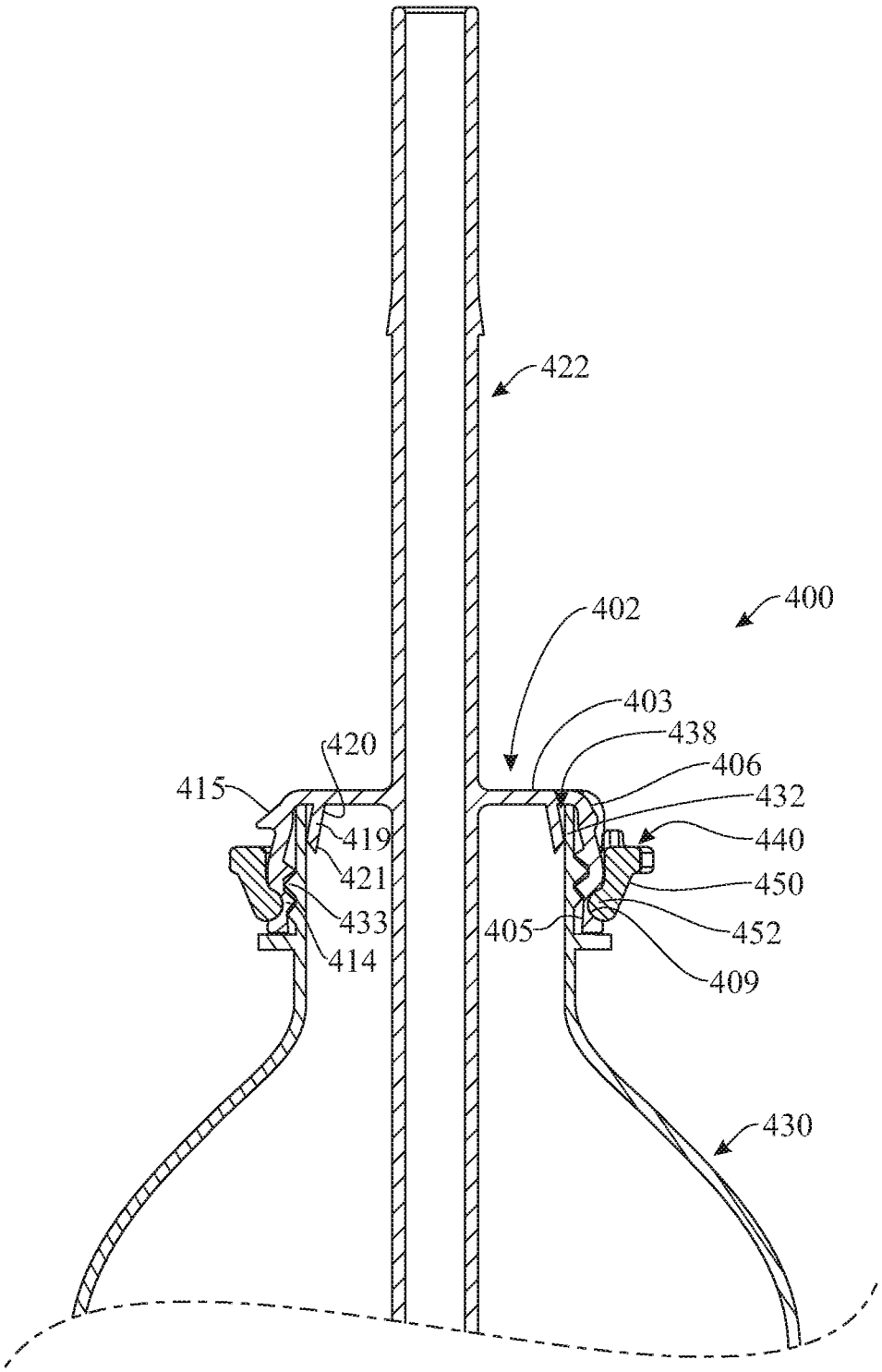
FIG. 14 presents a cross-sectional front elevation view of the fourth embodiment of the container cap with integrated straw of the present invention, mounted on the beverage container.

In typical application, the user inserts the straw 422 and optional straw extension 460 into the container, and threads the container cap 402 onto the container neck 432 by engaging the respective internal threads 414 and container threads 433, as shown in FIG. 14. The container neck 432 is placed in the neck space 438 between the cap flange 406 and the neck gripping member 419. The user then inserts the cap receiver 440 over the container cap 402, mates the radial ribs 413 with the notches 444, and pushes the cap receiver 440 down onto the container cap 402 until the cap receiver 440 overcomes the stop 415 and the radial ribs 413, reaching an initial, pre-sealing position shown in FIG. 13. In this initial position, the arms 450 and end protrusions 452 are arranged facing the gaps located between each pair of adjacent resilient cap lips 405. Next, the user can rotate the cap receiver 400 clockwise or counterclockwise in order to cause the cap receiver 440 to press against the container cap 402 and the container cap 402 to seal against the container neck 432. For instance, rotating the cap receiver 440 clockwise causes the end protrusion 452 of each arm 450 to engage with the recessed area 409 of the resilient cap lip 405 next to the gap in the clockwise direction, as shown in FIG. 14. The engagement causes the resilient cap lip 405 to flex inward and press against the container neck 432, which in turn presses against the neck gripping member 419, providing a watertight sealing between the neck gripping member 419 and the container neck 432 and/or between the container neck 432 and the resilient cap lips 405. Clockwise turning of the cap receiver 440 is limited by the second protrusions 448 eventually contacting a radial rib 413. Thus, when the user perceives that the cap receiver 440 can no longer rotate, the user acknowledges that watertight sealing has been achieved and that the container cap with integrated straw 400 is ready for use. Similarly, rotating the cap receiver 440 counterclockwise from the initial position of FIG. 13 causes the end protrusion 452 of each arm 450 to engage with the recessed area 409 of the resilient cap lip 405 next to the gap in the counterclockwise direction, again providing the sealing effect described heretofore. Counterclockwise turning of the cap receiver 440 is limited by the first protrusions 447 eventually contacting a radial rib 413. The T-shaped protuberances 410 can contribute to guide the cap receiver 440 while rotating in either direction.

In order to remove the container cap with integrated straw 400 from the beverage container 430, the user rotates the cap receiver 440 back to the initial, non-sealing position of FIG. 13, and unthreads the container cap 402. The cap receiver 440 remains retained to the container cap 402 by the stop 415.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A container with integrated straw, comprising:

a drinking straw, arranged along a longitudinal direction and comprising a straw intake end and a straw outlet end;

a container cap including a cap body extending radially outward from the drinking straw, a neck gripping member extending from the cap body, a cap flange extending from the cap body concentric with the neck gripping member, a neck space delimited by the neck gripping member and the cap flange, and at least one radially protruding rib; and a cap receiver, rotatably attachable to the container cap, the cap receiver comprising an opening configured to allow the container cap to pass through, the cap receiver further comprising at least one radial notch, wherein each notch of the at least one radial notch is sized to allow a corresponding radially protruding rib of the at least one radially protruding rib to longitudinally pass through said each notch; wherein the container with integrated straw is configured to adopt:

a non-sealing position, in which the cap receiver is rotatably arranged in a first position relative to the container cap such that the neck space presents a first size and the at least one radially protruding rib is arranged in longitudinal registration with the at least one radial notch;

a sealing position, in which the cap receiver is rotatably arranged in a second position relative to the container cap which is different from the first position and is such that the cap receiver presses against and deforms the container cap, the neck space presents a second size smaller than the first size, and the at least one radially protruding rib is not in longitudinal registration with the at least one radial notch, and further in which a protrusion of the cap receiver contacts the at least one protruding rib preventing further rotation of the cap receiver away from the non-sealing position.

2. The container with integrated straw of claim 1, wherein the neck gripping member and the cap flange extend from the cap body towards the straw intake end.

3. The container with integrated straw of claim 1, wherein the drinking straw is integrally formed with the container cap.

4. The container with integrated straw of claim 1, wherein the drinking straw and the container cap are separate parts, and the drinking straw is insertable through the container cap.

5. The container with integrated straw of claim 1, wherein an inner wall of the container cap is threaded.

6. The container with integrated straw of claim 5, wherein said inner wall of the container cap comprises an inner wall of the cap flange.

7. The container with integrated straw of claim 1, wherein the cap receiver comprises at least one protruding arm, and further wherein the cap flange is terminated in at least one resilient cap lip, wherein in the sealing position the cap receiver is rotatably arranged such that the at least one arm pushes the at least one resilient cap lip towards the neck gripping member.

8. The container with integrated straw of claim 7, wherein the at least one resilient cap lip comprises a plurality of resilient cap lips arranged in a spaced-apart configuration, and further wherein, in the non-sealing position, each protruding arm of the at least one protruding arm is arranged within a gap defined between each pair of adjacent resilient cap lips.

9. The container with integrated straw of claim 8, wherein the container cap comprises a thread extending along an inner wall of the cap flange and an inner wall of the at least one resilient cap lip.

10. The container with integrated straw of claim 7, wherein, in the non-sealing position, the at least one resilient cap lip is not deformed.

11. The container with integrated straw of claim 1, wherein the protrusion of the cap receiver extends longitudinally from the cap body towards the straw outlet end.

12. The container with integrated straw of claim 1, wherein the cap receiver further comprises a plurality of radial lobes.

13. The container with integrated straw of claim 1, wherein the container cap further includes a stop extending radially outward from the cap flange, the stop configured to allow the passing thereover of the cap receiver towards the straw intake end, thereby allowing to fit the cap receiver over the container cap to place the container with integrated straw in the non-sealing position, and the stop further configured to restrict the passing thereover of the cap receiver towards the straw outlet end, thereby preventing removal of the cap receiver from the container cap when the container with integrated straw is arranged in the non-sealing position.

14. The container with integrated straw of claim 1, further comprising a straw extension disconnectably attachable to the drinking straw.

15. A container with integrated straw, comprising:

a drinking straw, arranged along a longitudinal direction and comprising a straw intake end and a straw outlet end;

a container cap including a cap body extending radially outward from the drinking straw, a neck gripping member extending from the cap body towards the straw intake end, a cap flange extending from the cap body towards the straw intake end and concentric with the neck gripping member, a neck space delimited by the neck gripping member and the cap flange, and at least one radially protruding rib, wherein an inner wall of the cap flange is threaded; and a cap receiver, rotatably attachable to the container cap, the cap receiver comprising an opening configured to allow the container cap to pass through, the cap receiver further comprising at least one radial notch, wherein each notch of the at least one radial notch is sized to allow a corresponding radially protruding rib of the at least one radially protruding rib to longitudinally pass through said each notch; wherein the container with integrated straw is configured to adopt:

a non-sealing position, in which the cap receiver is rotatably arranged in a first position relative to the container cap such that the neck space presents a first size and the at least one radially protruding rib is in longitudinal registration with the at least one radial notch;

a sealing position, in which the cap receiver is rotatably arranged in a second position relative to the container cap which is different than the first position and is such that the cap receiver presses against and deforms the container cap, the neck space presents a second size smaller than the first size, and the at least one radially protruding rib is not in longitudinal registration with the at least one radial notch, and further in which a protrusion of the cap receiver contacts the at least one protruding rib preventing further rotation of the cap receiver away from the non-sealing position.

16. A container with integrated straw, comprising:

a drinking straw, arranged along a longitudinal direction and comprising a straw intake end and a straw outlet end;

a container cap including a cap body extending radially outward from the drinking straw, a neck gripping member extending from the cap body towards the straw intake end, a cap flange extending from the cap body towards the straw intake end and concentric with the neck gripping member, a neck space delimited by the neck gripping member and the cap flange, and at least one radially protruding rib, wherein an inner wall of the cap flange is threaded and the cap flange is terminated in at least one resilient cap lip; and a cap receiver, rotatably attachable to the container cap, the cap receiver comprising an opening configured to allow the container cap to pass through, and at least one protruding arm extending towards the straw intake end, the cap receiver further comprising at least one radial notch, wherein each radial notch of the at least one radial notch is sized to allow a corresponding radially protruding rib of the at least one radially protruding rib to longitudinally pass through said each notch; wherein the container with integrated straw is configured to adopt:

a non-sealing position, in which the cap receiver is rotatably arranged in a first position relative to the container cap such that the neck space presents a first size and the at least one radially protruding rib is in longitudinal registration with the at least one radial notch;

a sealing position, in which the cap receiver is rotatably arranged in a second position relative to the container cap which is different than the first position and is such that the at least one arm pushes the at least one resilient cap lip towards the neck gripping member, neck space presents a second size smaller than the first size, and the at least one radially protruding rib is not in longitudinal registration with the at least one radial notch, and further in which a protrusion of the cap receiver contacts the at least one protruding rib preventing further rotation of the cap receiver away from the non-sealing position.

17. The container with integrated straw of claim 16, wherein the at least one resilient cap lip comprises a plurality of resilient cap lips arranged in a spaced-apart configuration, and further wherein, in the non-sealing position, each protruding arm of the at least one protruding arm is arranged within a gap defined between each pair of adjacent resilient cap lips.

18. The container with integrated straw of claim 17, wherein the container cap comprises a thread extending along both the inner wall of the cap flange and an inner wall of the at least one resilient cap lip.

19. The container with integrated straw of claim 16, wherein, in the non-sealing position, the at least one resilient cap lip is not deformed.

* * * * *